US010662911B1

(12) United States Patent
Martin et al.

(10) Patent No.: US 10,662,911 B1
(45) Date of Patent: May 26, 2020

(54) FUEL TRANSFER SYSTEM INCLUDING A FUEL JET PUMP DEVICE AND UTILIZED IN A PARTITIONED FUEL TANK

(71) Applicant: DELPHI TECHNOLOGIES IP LIMITED, St. Michael (BB)

(72) Inventors: Thomas R. Martin, Chihuahua (MX); Luis Ochoa Rodriguez, Chihuahua (MX); Ricardo R. Dorado, Chihuahua (MX); David H. Gutierrez, Chihuahua (MX)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 16/276,773

(22) Filed: Feb. 15, 2019

(51) Int. Cl.
*F02M 37/02* (2006.01)
*F04F 5/10* (2006.01)
*F02M 37/00* (2006.01)

(52) U.S. Cl.
CPC ..... *F02M 37/025* (2013.01); *F02M 37/0029* (2013.01); *F02M 37/0094* (2013.01); *F04F 5/10* (2013.01)

(58) Field of Classification Search
CPC ..... F02M 37/025; F02M 37/0029; F02M 37/0094; F04F 5/10
See application file for complete search history.

(56) References Cited

U.S. PATENT DOCUMENTS 5,716,006 A * 2/1998 Lott ..... B05B 1/265 239/318
6,113,354 A 9/2000 Meese et al.
6,269,800 B1 8/2001 Fischerkeller et al.
6,276,342 B1 8/2001 Sinz et al.
6,405,717 B1 * 6/2002 Beyer ..... F02M 37/0029 123/509
6,505,644 B2 1/2003 Coha et al.
7,069,913 B1 * 7/2006 Crary ..... F02M 37/0052 123/509
8,622,715 B1 * 1/2014 Lott ..... F04F 5/10 366/163.2
2004/0079149 A1 4/2004 Sawert et al.
2005/0161027 A1 * 7/2005 Maroney ..... F02M 37/025 123/510

(Continued)

FOREIGN PATENT DOCUMENTS

DE 102014207221 A1 10/2015

*Primary Examiner* — Joseph J Dallo
(74) *Attorney, Agent, or Firm* — Joshua M. Haines

(57) ABSTRACT

A fuel system for a partitioned fuel tank includes a fuel pump assembly, a fuel jet pump device, a high pressure conduit, and a low pressure conduit. The tank defines a first chamber and a second chamber. The fuel pump assembly is disposed in the first chamber, and includes a motorized fuel pump. The jet pump device is disposed in the second chamber, and defines a low pressure passage adapted to draw fuel from the second chamber, a high pressure passage, and a mixing passage adapted to receive and mix fuel flowing from the low and high pressure passages. The high pressure conduit extends between the first and second chambers, and is in communication between an outlet of the fuel pump and the high pressure passage. The low pressure conduit extends between the first and second chambers, and is in communication between the mixing passage and the first chamber.

19 Claims, 4 Drawing Sheets

(56) References Cited

U.S. PATENT DOCUMENTS

| | | | | |
|---|---|---|---|---|
| 2006/0076287 | A1* | 4/2006 | Catlin | B01D 35/0273 210/416.4 |
| 2006/0231079 | A1* | 10/2006 | Paluszewski | F02M 37/025 123/514 |
| 2008/0142097 | A1* | 6/2008 | Rumpf | F02M 37/025 137/565.23 |
| 2009/0297366 | A1* | 12/2009 | Liang | F04F 5/10 417/84 |
| 2011/0146627 | A1* | 6/2011 | Oohashi | F02M 37/0029 123/497 |
| 2013/0048119 | A1 | 2/2013 | Kim et al. | |
| 2014/0314591 | A1 | 10/2014 | Herrera et al. | |
| 2017/0152823 | A1 | 6/2017 | McGrew et al. | |
| 2018/0283331 | A1 | 10/2018 | Porras et al. | |

* cited by examiner

FUEL TRANSFER SYSTEM INCLUDING A FUEL JET PUMP DEVICE AND UTILIZED IN A PARTITIONED FUEL TANK

BACKGROUND OF THE INVENTION

The present disclosure relates to a fuel storage and delivery system, and more particularly to a fuel transfer system including a fuel jet pump utilized in a partitioned fuel tank.

Traditional fuel storage and delivery systems that include saddle fuel tanks utilize fuel transfer systems that apply various methods to transfer fuel between chambers of the tank. Some fuel transfer systems include motor driven pumps located in a primary chamber that supply high pressure fuel to a separate jet pump, also located in the primary chamber, to draw fuel from an auxiliary chamber. The location of the jet pump in the primary chamber, and the design of the jet pump itself can lead to less than optimal fuel transfer performance. For example, traditional jet pumps include bodies made of plastic and insert with calibrated orifices made of brass. Such a material configuration can lead to poor fit conditions between the body and insert, and poor creep resistance when exposed to harsh fuel and temperature environments.

Accordingly, it is desirable to optimize the configuration and placement of jet pumps in a fuel transfer system along with optimizing jet pump designs.

SUMMARY OF THE INVENTION

According to one, non-limiting, embodiment of the present disclosure, a fuel system is adapted to be utilized in a partitioned fuel tank that defines a first chamber and a second chamber. The fuel system includes a fuel pump assembly, a fuel jet pump device, a high pressure conduit, and a low pressure conduit. The fuel pump assembly is adapted to be disposed in the first chamber, and includes a motorized fuel pump. The fuel jet pump device is adapted to be disposed in the second chamber, and defines a low pressure passage adapted to draw fuel from the second chamber, a high pressure passage, and a mixing passage adapted to receive and mix fuel flowing from the low and high pressure passages. The high pressure conduit is adapted to extend between the first and second chambers, and is in fluid communication between an outlet of the fuel pump and the high pressure passage. The low pressure conduit is adapted to extend between the first and second chambers, and is in fluid communication between the mixing passage and the first chamber.

In accordance with another embodiment, a fuel jet pump assembly includes a body and a tubular insert. The body defines a mixing passage, a low pressure passage, and a cavity in communication with one another at an intersection. The body further includes a stop face. The tubular insert includes opposite first and second end portions and a mid-portion. The mid-portion defines a high pressure passage extending along a centerline, extending axially between the first and second end portions, and disposed in the cavity. The first end portion is located at the intersection, and defines a calibrated orifice in fluid communication with the low pressure passage, the high pressure passage and the mixing passage. The second end portion includes an enlarged head projecting radially outward from the mid-portion, and defines an inlet port in fluid communication with the high pressure passage. The enlarged head includes a stop surface in axial contact with the stop face.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
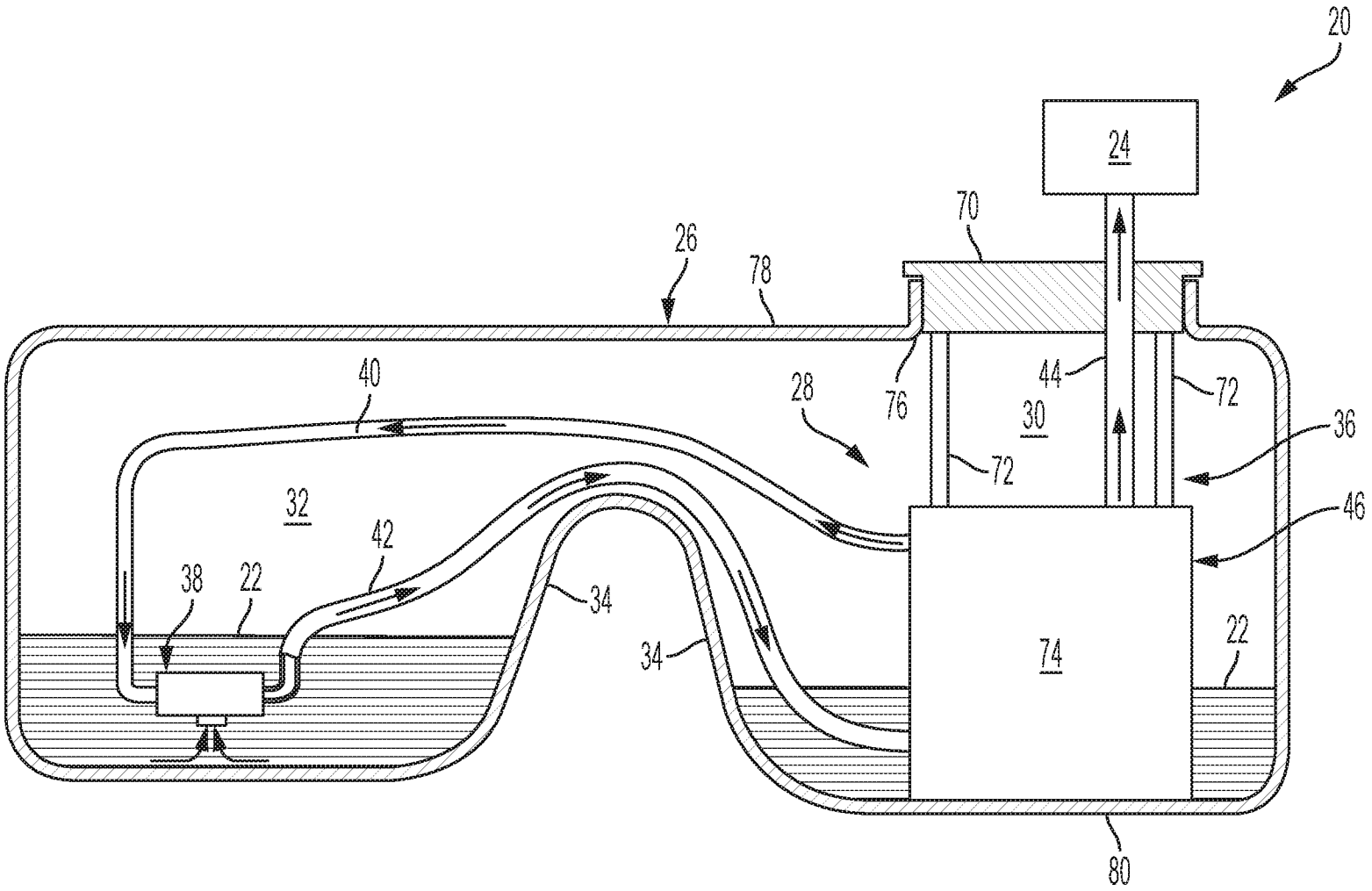
FIG. 1 is a cross section of the fuel delivery and transfer system as one exemplary embodiment of the present disclosure.

Referring now to the Figures, where the invention will be described with reference to specific embodiments, without limiting same, a fuel storage and delivery system 20 is illustrated in FIG. 1, and may be utilized to store fuel 22 in a transport vehicle (not shown) and deliver the fuel to a combustion engine 24 of the vehicle. The fuel storage and delivery system 20 includes a partitioned tank 26 (e.g., saddle tank) for storing the fuel 22, and a fuel transfer system 28 adapted to deliver the fuel 22 to the combustion engine 24.

The partitioned tank 26 may include boundaries that define a first chamber 30 and a second chamber 32 separated by a partition 34 of the tank. In one embodiment, the first chamber 30 may be a primary chamber and the second chamber 32 may be an auxiliary chamber in direct fluid communication with the primary chamber above the partition 34. The fuel 22 may be stored in the tank 26 at substantially atmospheric pressure. In another embodiment, the partitioned tank 26 may be two separate tanks, or compartments, in fluid communication with one another via at least one conduit (not shown).

Figure 2:
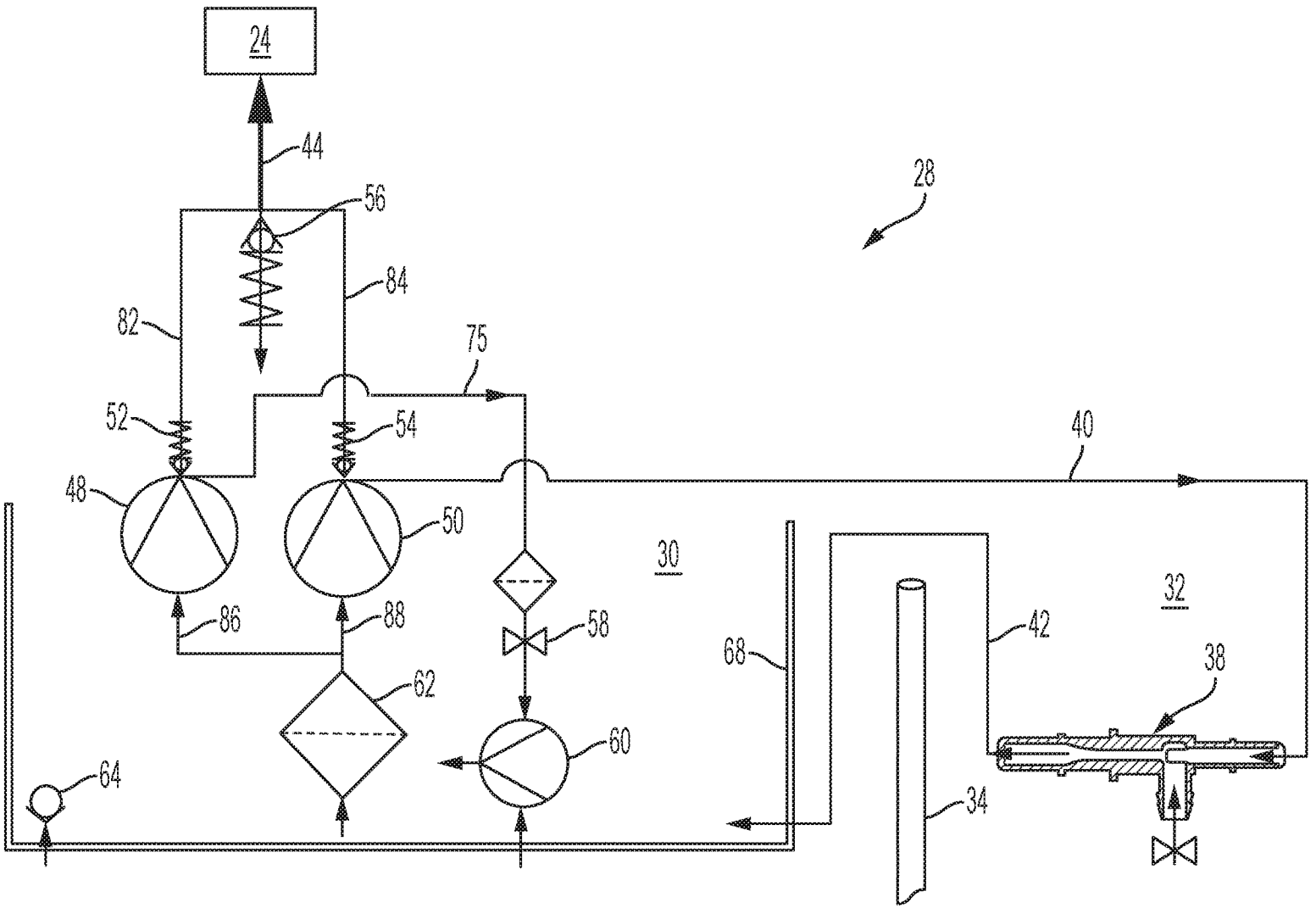
FIG. 2 is a schematic of a fuel transfer system of the fuel delivery and transfer system.

Referring to FIGS. 1 and 2, the fuel transfer system 28 of the fuel storage and delivery system 20 may include a fuel pump assembly 36, a fuel jet pump device 38, a high pressure conduit 40, and a relatively low pressure conduit 42. The fuel pump assembly 36 may be located in the first, or primary, chamber 30, and is constructed to draw fuel from both chambers 30, 32 and deliver pressurized fuel to the combustion engine 24 via a supply conduit 44.

The fuel pump assembly 36 of the fuel transfer system 28 may include a support structure 46 that may generally include a fuel reservoir 68, at least one fuel pump (i.e., two illustrated in FIG. 2 as 48, 50), at least one check valve (i.e. two illustrated in FIG. 2 as 52, 54), a pressure relief valve 56, an anti-siphon valve 58, a first, or primary, primary jet pump device 60, a strainer 62, an umbrella valve 64.

The support structure 46 of the fuel pump assembly 36 may generally include a lid 70, support stanchions or members 72 (i.e., two illustrated in FIG. 1), and a housing 74 (see FIG. 1). The lid 70 is adapted to sealably cover an opening 76 communicating through a wall 78 (e.g., upper wall) of the tank 26. The stanchions 72 extend between, and are connected to, the housing 74 and the lid 70. In one embodiment, the stanchions 72 are elongated and extend substantially vertically, to generally place the housing 74 proximate to a bottom wall 80 of the tank 26 that defines in-part the first chamber 30. The housing 74 is constructed to generally encapsulate and/or support the fuel pumps 48,50, the check valve 52, 54, the pressure relief valve 56, the anti-siphon valve 58, the primary jet pump device 60, the strainer 62, the umbrella valve 64, and the fuel reservoir 68. In one embodiment, the reservoir 68 may be a unitary part of the housing 74.

The fuel pumps 48, 50 are of the mechanically driven type, and thus may include electric motors (not shown) to drive the pumps. The first pump 48 may be adapted to supply pressurized fuel to the supply conduit 44, and the primary jet pump device 60. The high pressure fuel flowing to the primary jet pump device 60 facilitates the drawing of low pressure fuel by the primary jet pump device 60 from the first chamber 30. The low pressure fuel is then mixed with the incoming high pressure fuel from the first pump 48, and the primary jet pump device 60 then expels the mixed fuel at a low pressure into the reservoir 68.

The second pump 50 is adapted to supply pressurized fuel to the supply conduit 44 and the fuel jet pump device 38. The fuel jet pump device 38 is constructed to draw low pressure fuel from the second chamber 32, mix the low pressure fuel with the incoming high pressure fuel from the second pump 50, and expel the mixed fuel at a low pressure into the reservoir 68. In one embodiment, the mixed fuel from either jet pump devices 60, 38 may be at about atmospheric pressure.

Each fuel pump 48, 50 includes respective outlets 82, 84 (i.e., outlet conduits) and respective inlets 86, 88 (i.e., inlet conduits). Each outlet 82, 84 communicates directly with the supply conduit 44, and each inlet 86, 88 is in fluid communication with the strainer 62. The strainer 62 is constructed to draw fuel from the reservoir 68, and thus provide filtered fuel to both pumps 48, 50.

The check valves 52, 54 are located at respective outlets 82, 84 of each respective pump 48, 50, and are adapted to prevent the backflow of fuel through the pumps. The pressure relief valve 56 is in fluid communication with the supply conduit 44, and is adapted to expel fuel from the supply conduit 44 and, in one example, back into the reservoir 68 upon overpressure conditions. The umbrella valve 64 communicates through a bottom portion of the reservoir 68, and facilitates level control of fuel within the reservoir 68.

The primary jet pump device 60 receives high pressure fuel from pump 48 via a high pressure conduit 75 that extends between the outlet 82 (i.e., upstream of the check valve 52) and the primary jet pump device 60. The anti-siphon valve 58 may be located in the high pressure conduit 75 (i.e., interposes), and is adapted to prevent siphoning of fuel from the first chamber 30, back-flowing through the primary jet pump device 60, and back-flowing through the pump 48 when the pump 48 is idle.

Figure 3:
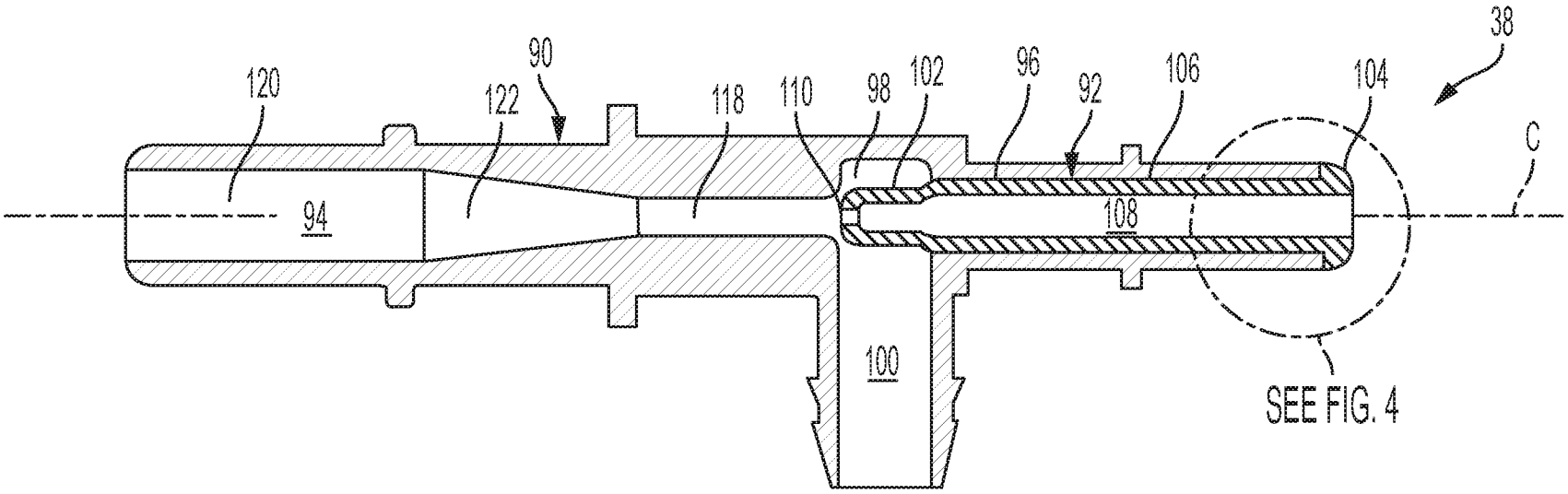
FIG. 3 is a cross section of a jet pump of the fuel transfer system.

Referring to FIGS. 2 and 3, the fuel jet pump device 38 includes a body 90 that may be a unitary body, and an insert 92 that may be tubular and interchangeable. The body 90 defines a mixing passage 94, a cavity 96, an intersection 98, and a low pressure passage 100. The mixing passage 94, the cavity 96, and the low pressure passage 100 are in fluid communication with one another generally at the intersection 98. In one embodiment, the mixing passage 94 and the cavity 96 extend along, and are centered to, a common centerline C. The intersection 98 is axially located between the mixing passage 94 and the cavity 96.

Referring to FIG. 3, when the fuel jet pump device 38 is assembled, the insert 92 is substantially located in the cavity 96, and sealably seats against the body 90. In one embodiment, the insert 92 includes opposite end portions 102, 104 and a mid-portion 106 that extends axially between the end portions 102, 104 and along the centerline C. The mid-portion 106 is tubular, and at least in-part, includes boundaries that define a high pressure passage 108. The high pressure passage 108 is in fluid communication with the intersection 98 via a calibrated orifice 110 defined by the end portion 102 and centered to the centerline C. The end portion 102 may be in, or proximate to, the intersection 98.

The end portion 104 may be, or may include, an enlarged head that projects radially outward from the mid-portion 106. The end portion 104 may be annular in shape, and radially inwardly defines an inlet port 112 in fluid communication between the high pressure passage 108 and the high pressure conduit 40. In one example, the end portion 104 carries a stop surface 114 that faces axially toward the end portion 102, and may be annular in shape. The cavity 96 communicates through the body 90 at an end that carries a stop face 116 that faces axially, opposes the stop surface 114, may be annular in shape, and may be centered to centerline C. When the fuel jet pump device 38 is assembled, the stop surface 114 is in contact with the stop face 116, which facilitates placement (i.e., axial indexing) of the calibration orifice 110 in the intersection 98.

Figure 4:
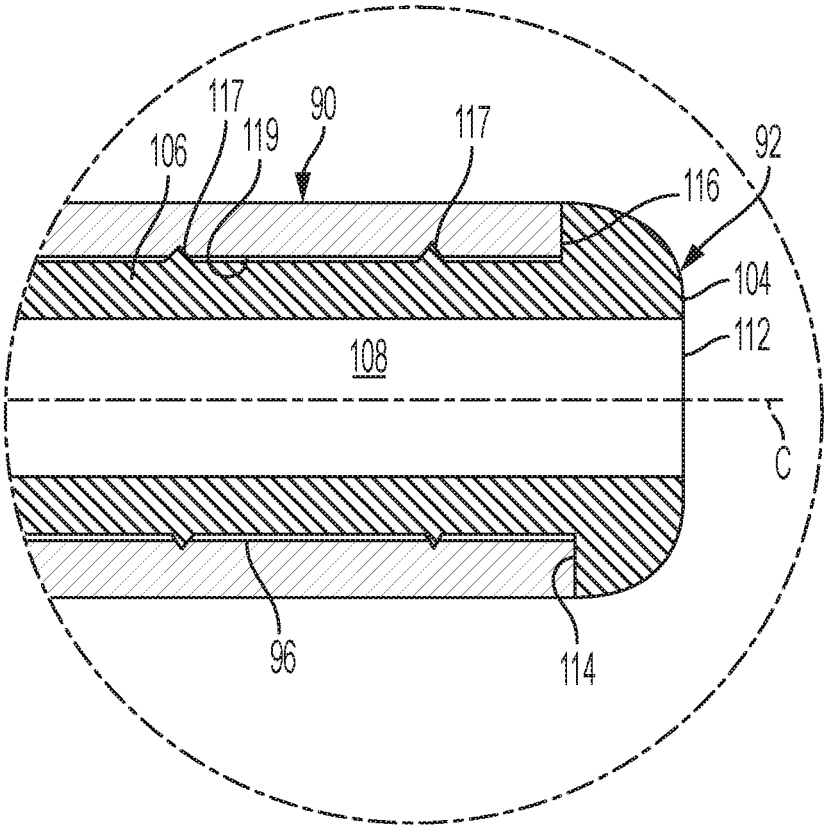
FIG. 4 is an enlarged, partial, cross section of the jet pump taken from circle 4 of FIG. 3.

The mid-portion 106 of the tubular insert 92 may include at least one circumferentially continuous barb 117 (i.e., two illustrate in FIG. 4) spaced axially apart from one-another. Each barb 117 is in biased radial contact with a circumferentially continuous seat 119 of the body 90 that defines, at least in-part, the cavity 96. As illustrated in FIG. 4, the seat 119 faces radially inward, is cylindrical, and substantially defines the cavity 96.

The mixing passage 94 defined by the body 90 may include a two tubular, or cylindrical, segments 118, 120 extending along the centerline C, and axially spaced apart from one-another by a venturi segment 122. The cylindrical segment 118 includes a diameter that is less than a diameter of cylindrical segment 120, and communicates axially between the intersection 98 and the venturi segment 122. The cylindrical segment 120 communicates through the body 90, and between the venturi segment 122 and the low pressure conduit 42.

The mixing passage 94 and the cavity 96 may be substantially aligned axially and co-extend axially along the centerline C. The low pressure passage 100 may be generally normal to the mixing passage 94. In one embodiment, the body 90 and the insert 92 are made of the same material, and both may be made of plastic. The insert 92 may further be interchangeable with other inserts having varying sized orifices. The ideal insert 92 may then be chosen to meet specific fluid dynamics of any particular delivery system 20.

It is contemplated and understood that the insert 92 may not generally be tubular, and instead may be disc-shaped with a centrally located orifice. In this example, an axially leading surface of the disc may contact an axial face of the body 90. That is, the disc-like insert 92 may seat within a counter-bore in the body.

It is further contemplated and understood that design attributes of the fuel jet pump device 38 may be applied to the primary jet pump device 60.

In operation of the fuel jet pump device 38, high pressure fuel produced by the pump 50, flows through the high pressure conduit 40, axially through the high pressure passage 108, through the calibration orifice 110, and generally into the intersection 98 immediately adjacent to the segment 118 of the mixing passage 94. The high pressure flow through the calibration orifice 110 causes the low pressure passage 100 to draw fuel from the second chamber 32. This low pressure fuel flows through the low pressure passage 100, through at least a portion of the intersection 98 and into the segment 118 of the mixing passage 94. The high and low pressure fuel is then mixed and reduced in pressure as it flows through the segment 118, through the venturi segment 122, through the segment 120, and into the low pressure conduit 42. The low pressure conduit 42 may then deliver the fuel to the reservoir 68 in first chamber 30.

Advantage and benefits of the present disclosure include: a reduction in the amount of critical high pressure assembly interfaces within the jet pump device, a flexible jet pump design that is easily adaptable for saddle tank application which traditionally demand high performance transfer systems, a self-centered plastic molded insert 92 with a calibrated orifice 110 and indexing features for proper position of the orifice, a reduced amount of components from more traditional designs, and a reduced likelihood of burrs and machined defects that more negatively impact system performance.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A fuel system adapted to be utilized in a partitioned fuel tank that defines a first chamber and a second chamber, the fuel system comprising:

a fuel pump assembly adapted to be disposed in the first chamber, the fuel pump assembly including a motorized fuel pump;

a fuel jet pump device adapted to be disposed in the second chamber and defining a low pressure passage adapted to draw fuel from the second chamber, a high pressure passage, and a mixing passage adapted to receive and mix fuel flowing from the low and high pressure passages;

a high pressure conduit adapted to extend between the first and second chambers, and in fluid communication between an outlet of the fuel pump and the high pressure passage; and a low pressure conduit adapted to extend between the first and second chambers, and in fluid communication between the mixing passage and the first chamber.

2. The fuel system set forth in claim 1, wherein the fuel jet pump device defines a calibrated orifice and an intersection, the calibrated orifice being in fluid communication between the high pressure passage and the intersection, and the intersection adapted to receive fuel from the low pressure passage and the calibrated orifice and expel fuel into the mixing passage.

3. The fuel system set forth in claim 2, wherein the fuel jet pump device includes a body that defines the mixing passage, the low pressure passage, the intersection, and a cavity in communication with the intersection, and includes a tubular insert disposed in the cavity and seated to the body, the tubular insert defining the calibrated orifice and the high pressure passage.

4. The fuel system set forth in claim 3, wherein the body defines a venturi as part of the mixing passage.

5. The fuel system set forth in claim 4, wherein the cavity and the high pressure passage are substantially aligned axially and co-extend axially along a centerline, and the body includes a stop face facing axially and in contact with an axially opposing stop surface of the tubular insert.

6. The fuel system set forth in claim 5, wherein the tubular insert includes opposite first and second end portions and a mid-portion extending axially between the first and second end portions, the mid-portion defining the high pressure passage, the first end portion being located at the intersection and defining the calibrated orifice, the second end portion including an enlarged head projecting radially outward from the mid-portion and defining an inlet port in fluid communication with the high pressure passage, the enlarged head including the stop surface.

7. The fuel system set forth in claim 6, wherein the body and the tubular insert are made of plastic.

8. The fuel system set forth in claim 7, wherein the stop face and the stop surface are annular in shape and centered about the centerline.

9. The fuel system set forth in claim 1, wherein the fuel pump assembly includes a structure that defines a reservoir, and the low pressure conduit is adapted to flow fuel from the second chamber and into the reservoir.

10. The fuel system set forth in claim 9, wherein the fuel pump is adapted to draw fuel from the reservoir.

11. A fuel jet pump assembly comprising:

a body defining a mixing passage, a low pressure passage, and a cavity in communication with one another at an intersection, the body including a stop face; and a tubular insert including opposite first and second end portions and a mid-portion, the mid-portion defining a high pressure passage extending along a centerline, extending axially between the first and second end portions, and disposed in the cavity, the first end portion located at the intersection and defining a calibrated orifice in fluid communication with the low pressure passage, the high pressure passage and the mixing passage, the second end portion including an enlarged head projecting radially outward from the mid-portion and defining an inlet port in fluid communication with the high pressure passage, the enlarged head including a stop surface in axial contact with the stop face.

12. The fuel jet pump assembly set forth in claim 11, wherein the body and the tubular insert are made of plastic.

13. The fuel jet pump assembly set forth in claim 11, wherein the stop face and the stop surface are annular in shape and centered to the centerline.

14. The fuel jet pump assembly set forth in claim 11, wherein the calibrated orifice is centered to the centerline.

15. The fuel jet pump assembly set forth in claim 11, wherein the tubular insert is interchangeable.

16. The fuel jet pump assembly set forth in claim 11, wherein the high pressure passage flows fuel from the inlet port and through the calibrated orifice, the low pressure passage flows fuel into the intersection, and the mixing passage flows fuel emitted from the intersection.

17. The fuel jet pump assembly set forth in claim 11, wherein the mixing passage extends along the centerline, and includes a venturi segment extending axially.

18. The fuel jet pump assembly set forth in claim 17, wherein the mixing passage includes a tubular segment communicating axially between the intersection and the venturi segment.

19. The fuel jet pump assembly set forth in claim 11, wherein the mid-portion includes a circumferentially continuous barb in biased radial contact with a circumferentially continuous seat of the body that defines at least in-part the cavity.

* * * * *